US005165311A

United States Patent [19]

Louw

[11] Patent Number: 5,165,311

[45] Date of Patent: * Nov. 24, 1992

[54] PNEUMATIC NUT INSTALLATION TOOL

[75] Inventor: John A. Louw, Temecula, Calif.

[73] Assignee: VSI Corporation, Chantilly, Va.

[ * ] Notice: The portion of the term of this patent subsequent to Sep. 3, 2008 has been disclaimed.

[21] Appl. No.: 716,312

[22] Filed: Jun. 17, 1991

Related U.S. Application Data

[63] Continuation of Ser. No. 542,256, Jun. 21, 1990, Pat. No. 5,044,225.

[51] Int. Cl.[5] ..... B25B 23/06

[52] U.S. Cl. ..... 81/430; 81/448

[58] Field of Search ..... 81/55, 56, 57.14, 57.3, 81/57.37, 125, 430, 448, 451

[56] References Cited

U.S. PATENT DOCUMENTS

| | | | |
|---|---|---|---|
| 3,247,741 | 4/1966 | Batten | 81/56 |
| 3,750,257 | 8/1973 | Berecz . | |
| 3,855,883 | 12/1974 | Stumpf et al. | 81/125 |
| 4,260,005 | 4/1989 | Stencel . | |
| 4,602,537 | 7/1986 | Dixon | 81/430 |
| 4,617,844 | 10/1986 | Batten | 81/56 X |
| 4,945,789 | 8/1990 | Martinengo | 81/55 |

OTHER PUBLICATIONS

Drawing No. D119248, Huck Manufacturing Company.

Hi-Shear Corporation, Tool Catalog, HLA1032, 4 sheets, 1971.

Hi-Shear Corporation, Tool Catalog, HLA1102, 4 sheets, 1971.

Huck Manufacturing Co., Instruction Manual For Model 435-in-Line Automatic Collar Feeding Device, HK693L Mar. 15, 1984.

*Primary Examiner*—James G. Smith

*Attorney, Agent, or Firm*—Christie, Parker & Hale

[57] ABSTRACT

A pneumatic nut installation tool has a plunger assembly which advances from a retracted position near the rear of the tool through a nut pickup station to an extended position extending from the front of the tool. A nut shuttle delivers a nut in front of the plunger assembly before it reaches the nut pickup station and retracts away from the nut pickup station before the plunger assembly moves through that station. The nut is picked up on an assembly that includes a split spring ring which engages the bore of the nut. The spring ring is mounted on a fixed member, which also includes a hexagonal key for preventing rotation of a bolt as the nut is threaded onto it. A rotating nut driver moves over the outside of the nut picked up by the nut pickup assembly for threading the nut onto a bolt.

4 Claims, 14 Drawing Sheets

PNEUMATIC NUT INSTALLATION TOOL

This is a continuation of application Ser. No. 07/542,256 filed Jun. 21, 1990, now U.S. Pat. No. 5,044,225.

FIELD OF THE INVENTION

This invention relates to a tool for installing threaded nuts on a threaded pin or the like. It is particularly useful for installing a nut as described in U.S. Pat. No. 4,260,005, although also useful for standard hexagonal nuts or the like.

BACKGROUND OF THE INVENTION

A variety of automatic tools have been developed over the years for rapidly installing nuts or collars on high-strength aerospace fasteners. Typically these automatic tools are pneumatically operated and can be used rapidly so that the myriad number of fasteners on modern aircraft or the like can be installed with a minimum amount of assembly time.

There are a variety of requirements for such tools. Nuts should be automatically delivered to the tool in a position to be quickly installed on a bolt without manual intervention by the operator. For example, the tools should be useable in any orientation since the fasteners to be assembled may sometimes be overhead or beneath the worker or in front of the worker using the tool. For threaded fasteners, it is often desirable to provide a nonrotating key coaxial with a rotating nut to keep the threaded fastener or "pin" from rotating until the nut is installed.

Naturally, there are certain operating efficiencies which are also desirable. For example, the tools should operate quickly and reliably to provide uniform tightening of nuts on bolts. Preferably the time between installing one nut and having the next nut ready for installation should be minimized. The amount of air usage should be minimized.

Some nuts, such as those in U.S. Pat. No. 4,260,005, have a flange which is assembled against the workpiece being connected by the fastener. The mechanisms for handling such nuts must be designed to accommodate such a flange. The flange geometries may vary with different embodiments of nuts and some adaptability in that regard is therefore desirable in the automatic nut installation tool.

With the special nut mentioned above, the driver for the nut is relatively large and the operating mechanisms must accommodate this size. Such a nut has three outwardly extending lobes on its outer surface which are engaged by a generally triangular or deltoid driver. When the nut has been tightened onto the bolt with a preselected clamp-up force, the driver deforms the lobes radially inwardly so that the external surface of the nut is substantially round. The deformation of the lobes also deforms the inside of the nut for engaging a somewhat nonround thread on the bolt, thereby inhibiting removal of the nut from the bolt. Furthermore, the deformation of the lobes occurs at a preset force so that the clamp-up load installed on the workpiece by the fastener is well known.

Because of the requirement for deforming the lobes on the nut, a strong and abrasion resistant nut driver is required. Typically this is made of cemented tungsten carbide, which tends to be a brittle material subject to breakage in tension. The driver is therefore mounted in a steel backup sleeve to provide the required strength. This results in a driver which is substantially larger than the nut and may also be larger than required for other types of fasteners.

A prior nut installation tool uses a ring-shaped shuttle for delivering a flanged nut in front of a driver. The outside diameter of the driver is the same size as the diameter of the flange on the nuts used with the device. Thus, the driver may pass through the shuttle. When the driver is larger than the flange on the nut, a different type of shuttle must be used where the shuttle moves out of the way of the nut driver.

Another device available from Huck Manufacturing Co. for installing swaged collars has a shuttle which moves out of the way of a collar pick up pin. In that device there is a pin which enters the bore of a collar. Since this is not a portable device and always operates in a vertical orientation, the collar fits loosely on the pin. Furthermore, when the swaged collar is tightened there is no rotation of the collar relative to the nut. Thus, the operating mechanisms are not, in general, suitable for installing threaded fasteners.

In an automatic nut driver as shown in U.S. Pat. No. 3,750,257, which is suitable for threaded fasteners, the entire pneumatic cylinder rotates, a situation which is undesirable because of opportunities for leakage.

It is also desirable to use a standard pneumatic wrenching tool for the automatic nut installation tool rather than manufacturing new pneumatic components. This appreciably diminishes the cost of the nut installation tool, since the pneumatic motor, gearbox and the like, need not be specially manufactured. By simply mounting the entire apparatus on a standard pneumatic wrench, one can also provide for easy replacement and repair of the components, as may be required from time to time.

SUMMARY OF THE INVENTION

Several aspects of a nut installation tool are, therefore, provided in practice of this invention to address such concerns. For example, a nut installation tool in a presently preferred embodiment includes means for advancing and rotating a nut for assembly on a bolt. A shuttle arm is movable between a nut delivery position in front of the means for advancing the nut and a nut receiving position, which is out of the way. A movable gate mounted on the shuttle arm has a nut receiving cavity which is in front of the means for advancing the nut when the arm is in its nut-delivery position. The cavity has an enlarged mid-portion for accommodating a flange on the nut. Means are also provided for opening the movable gate when the shuttle arm is in its nut-receiving position and closing the gate when it moves toward the nut-delivery position.

The tool has means for rotating the nut adjacent to the workpiece and a non-rotatable shaft within the rotatable member. A split spring ring on the shaft picks up the nut at the nut-delivery station and resiliently holds it. The spring ring rotates when the nut rotates during assembly on a bolt. The non-rotatable shaft includes a key for keeping a bolt from rotating. There are also means for resiliently biasing the shaft within the rotatable driver for accommodating axial advance of the driver along the length of the nut.

When the installation tool operates, a nut-delivery plunger axially shifts from a retracted position to a pick-up position where the split ring on the shaft enters the bore of a nut in the shuttle. The nut shuttle is then retracted for clearing the nut as it advances further with the plunger. The plunger then advances a second distance toward a workpiece where it is threaded onto a bolt by the rotating driver. Meanwhile, another nut is fed to the nut shuttle in its retracted position.

BRIEF DESCRIPTION OF THE DRAWINGS

These and other features and advantages of the present invention will be appreciated as the same becomes better understood by reference to the following detailed description when considered in connection with the accompanying drawings wherein:

FIGS. 10*a* through 10*g* are schematic illustrations of the pneumatic connections of the installation tool at sequential stages during its cycle of operation.

DETAILED DESCRIPTION

Figure 1:
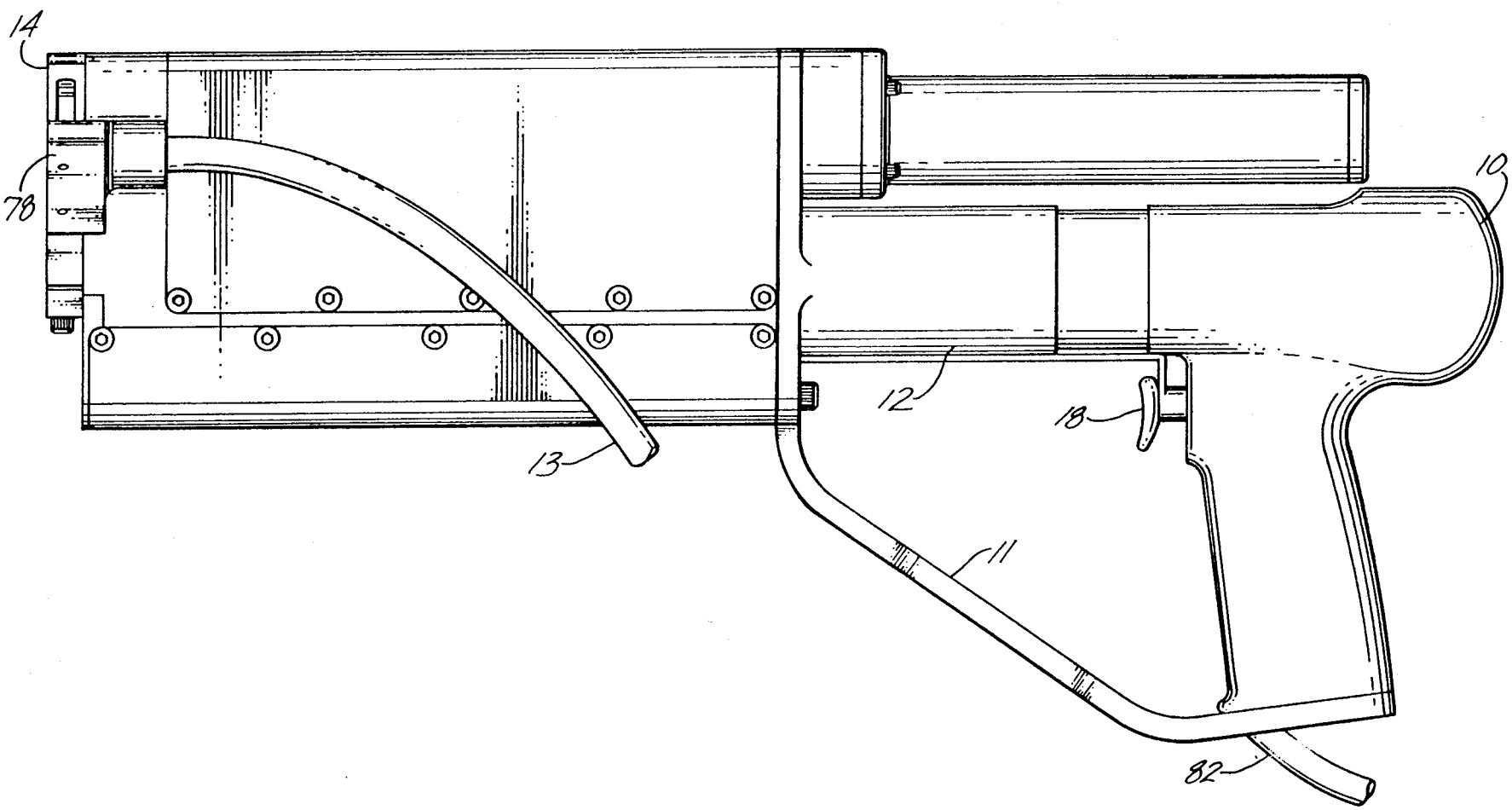
FIG. 1 is a general side view of an automatic nut installation tool constructed according to principles of this invention.

The nut installation tool is mounted on a conventional pistol-grip pneumatic wrench 10. The tool fits on the pneumatic wrench by way of a hand guard strap 11, which connects to the pistol grip of the wrench and a rear housing member 12 which fits over the gear box and chuck of the air motor. A flexible tube 13 pneumatically delivers nuts, one-by-one, to a nut-delivery shuttle 14 on the front of the tool.

A nut plunger assembly 16 extends along essentially the entire length of the installation tool. The nut plunger is illustrated in its fully-retracted position in FIG. 2. The nut plunger is also shown in its retracted position in the schematic illustrations of FIGS. 10*a*, 10*b*, and 10*g*. The plunger assembly is in the retracted position when the trigger 18 of the pneumatic motor is released and ordinarily remains in this retracted position when the installation tool is not in use.

Figure 3:
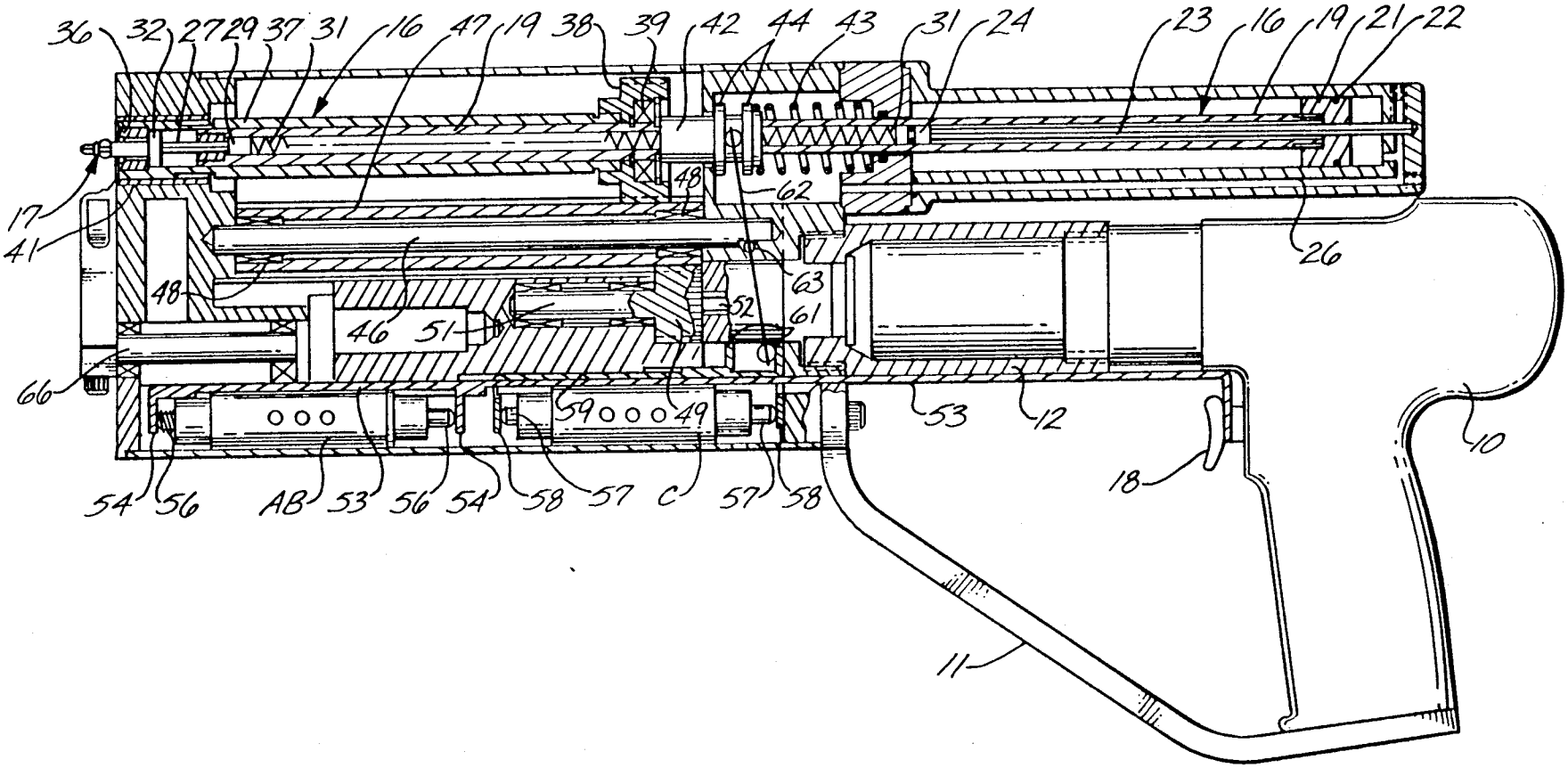
FIG. 3 is a longitudinal cross-section through the tool in its nut pickup position.
Figure 9:
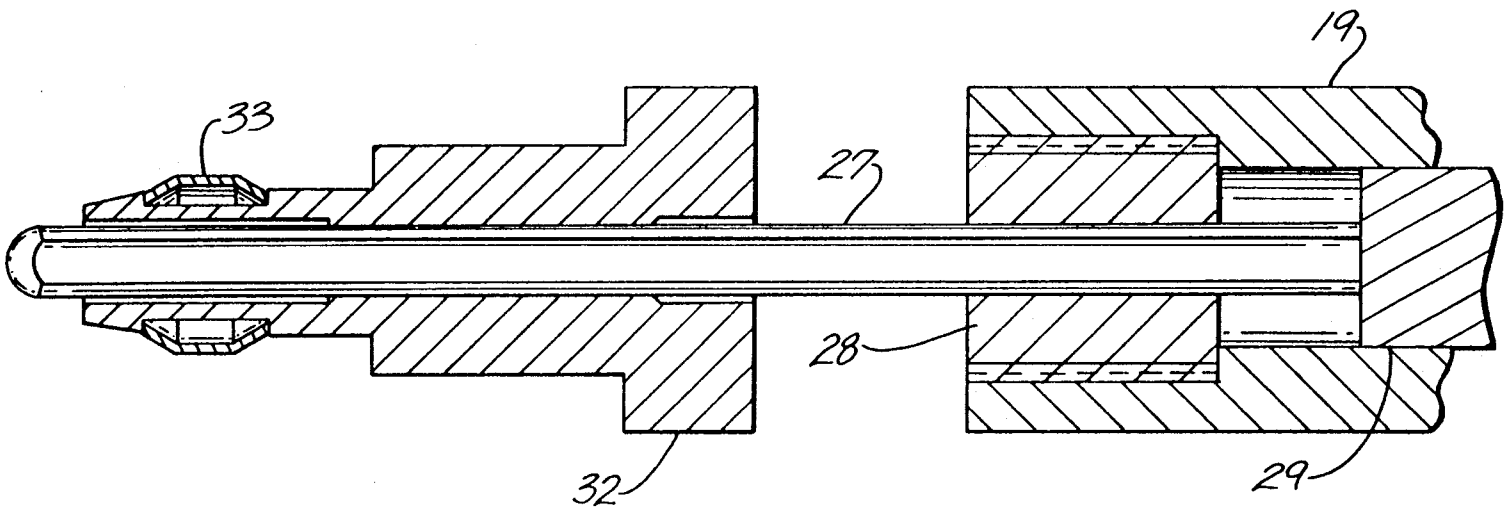
FIG. 9 is a detail, in partial longitudinal cross-section, of the nut pickup assembly.
Figure 10A:
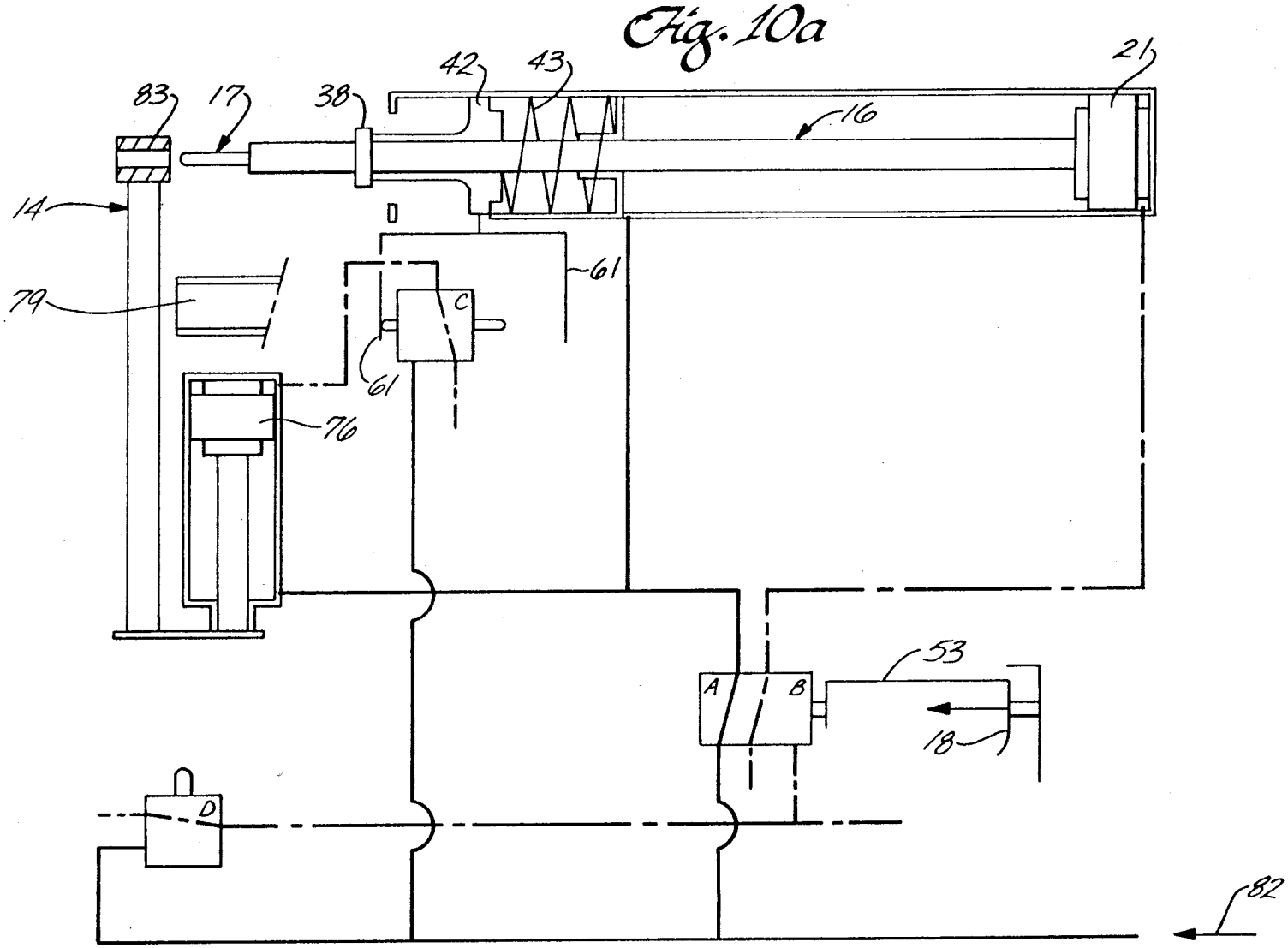
Figure 10B:
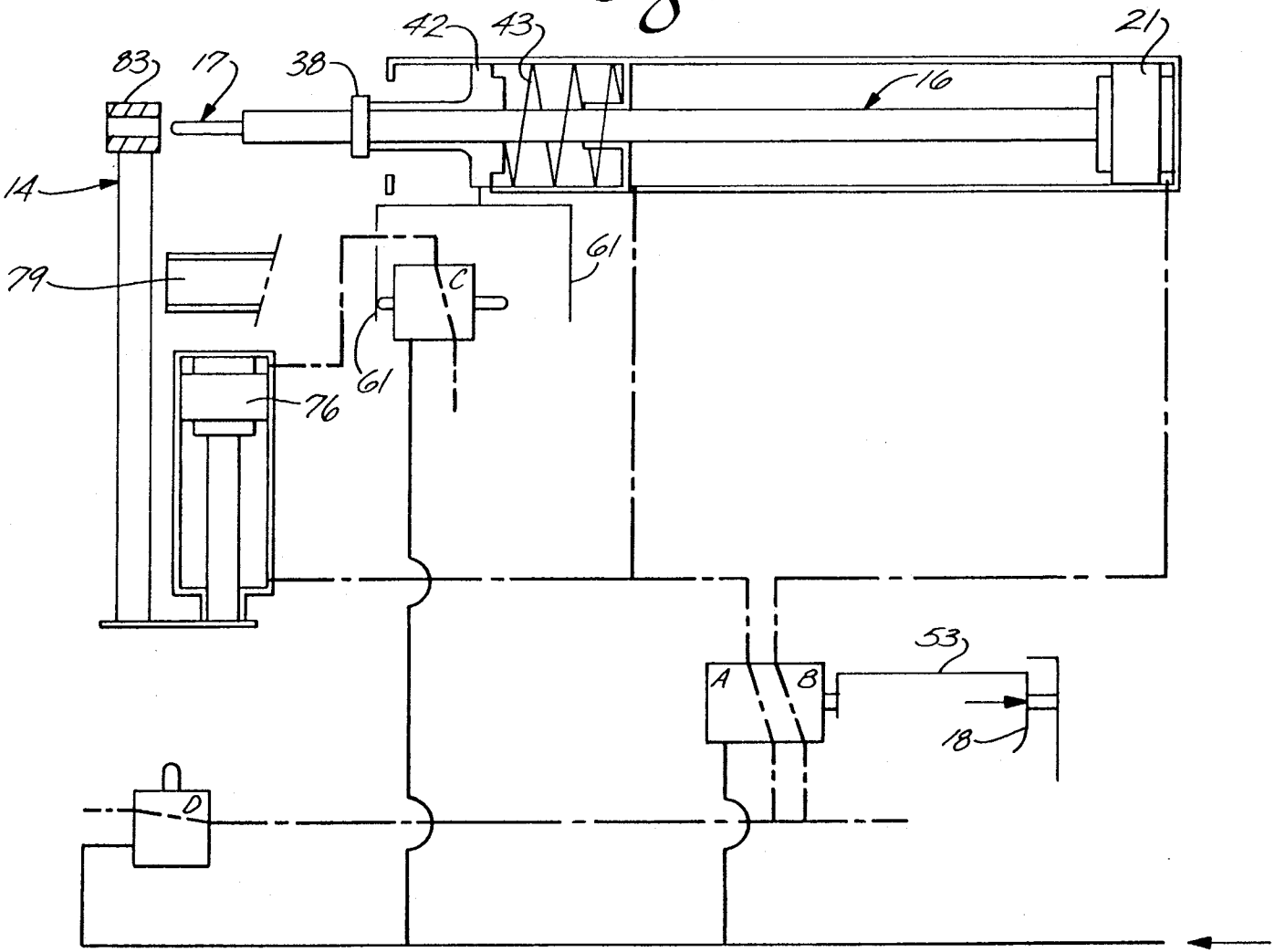
Figure 10C:
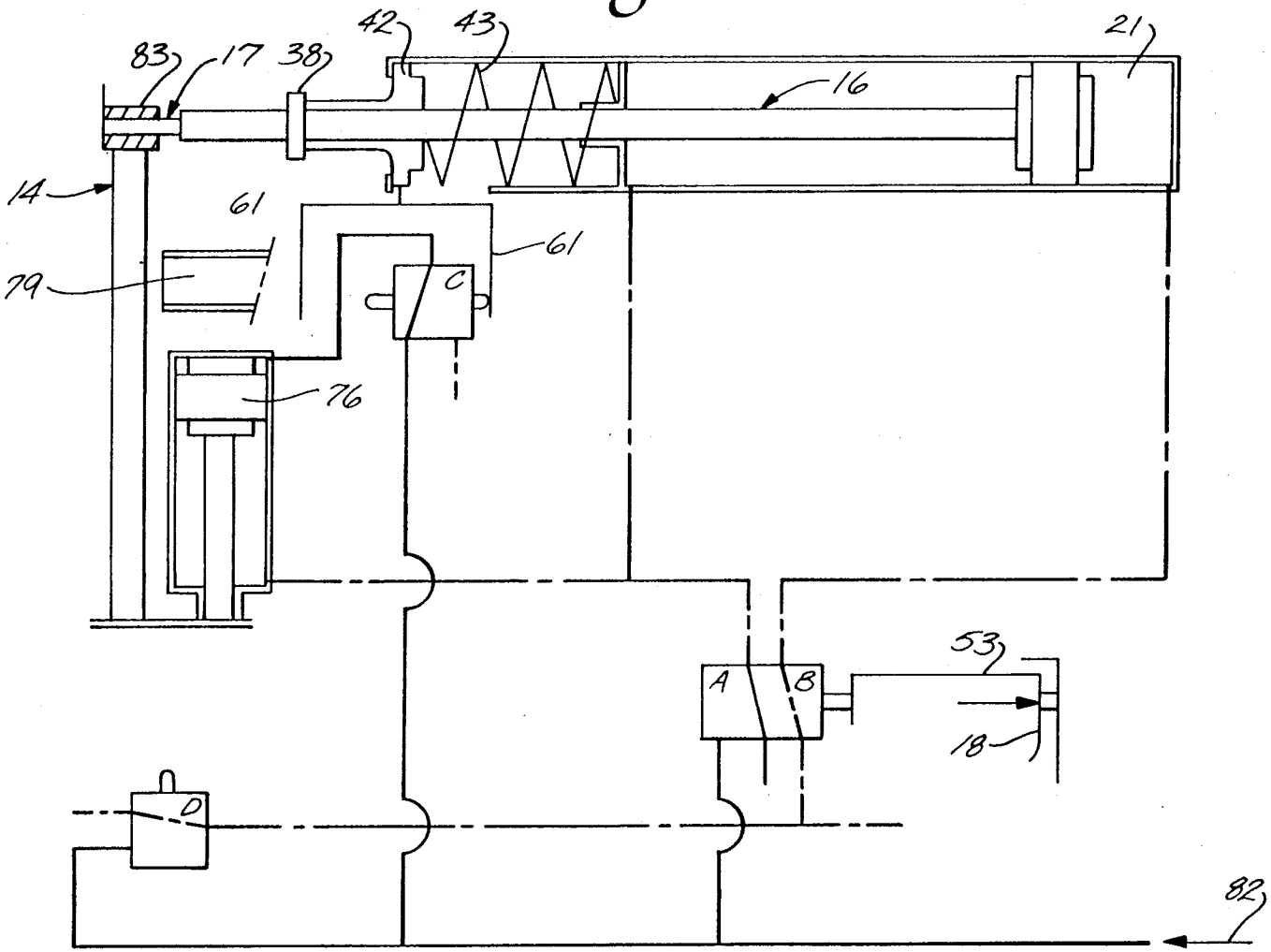
Figure 10D:
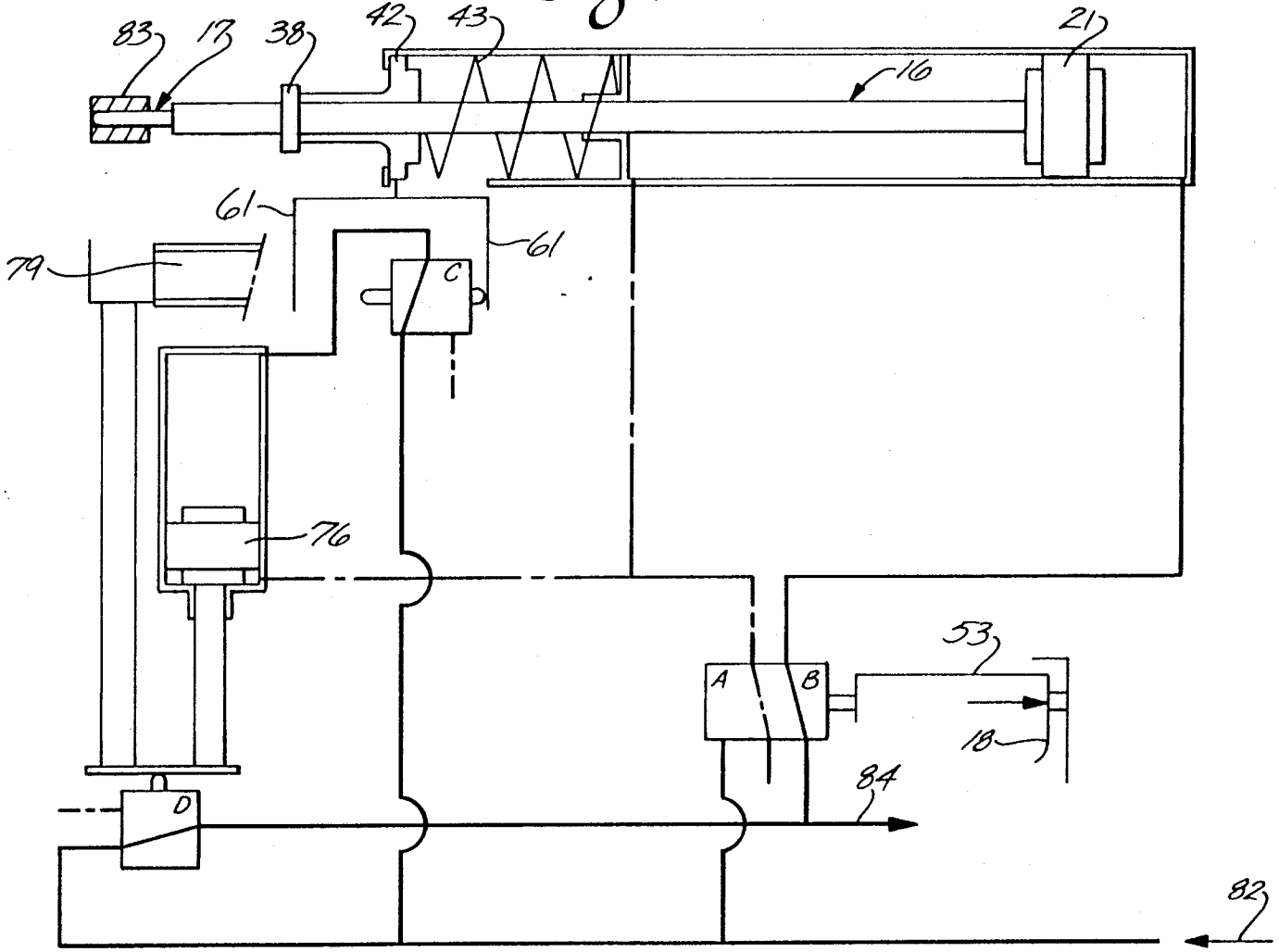

The plunger assembly is shown in its intermediate nut pickup position in FIG. 3 and also in the schematic illustrations of FIGS. 10*c* and 10*d*. It is in this position that a nut pickup mechanism 17 illustrated in longitudinal cross section in FIG. 9 enters a nut in the nut shuttle 14 prior to delivery of the nut to a workpiece. This intermediate position is held momentarily shortly after the trigger 18 of the pneumatic wrench is depressed.

Figure 4:
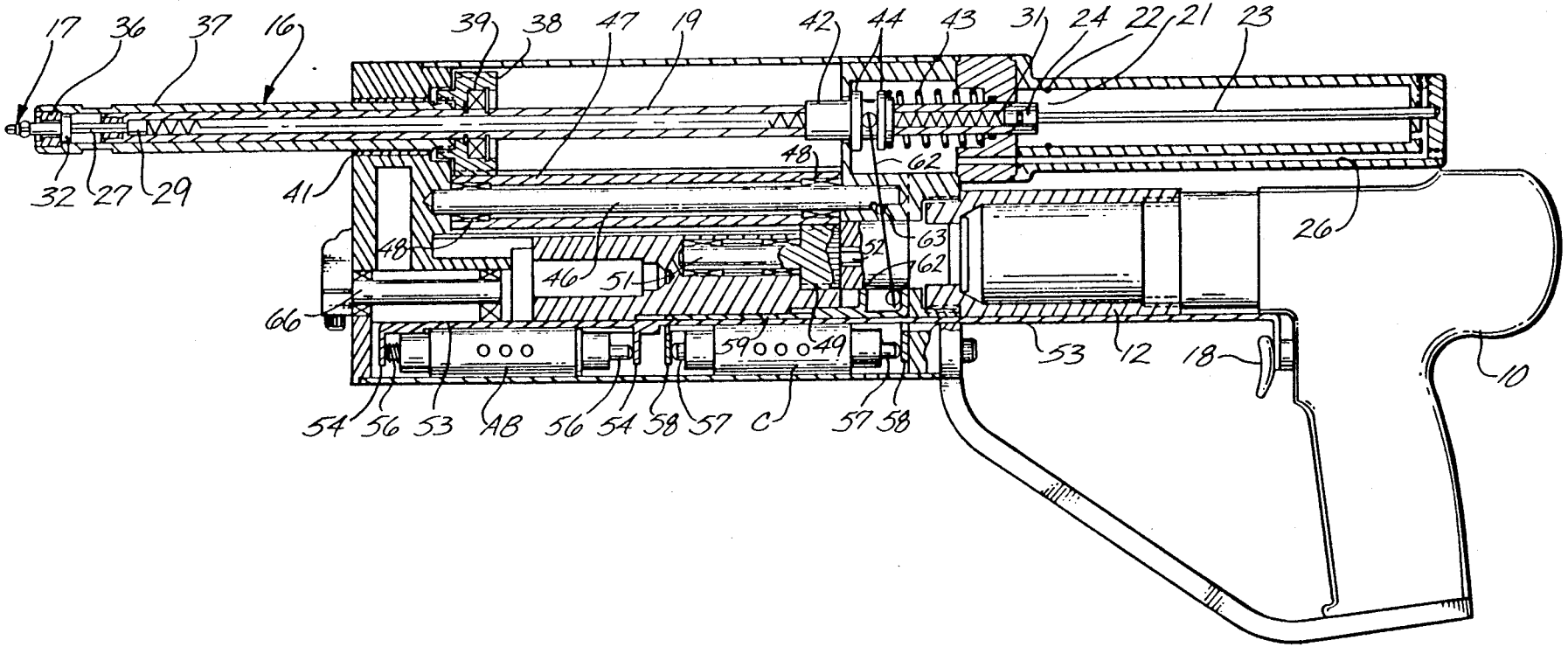
FIG. 4 is a longitudinal cross section through the tool in its extended position.
Figure 10E:
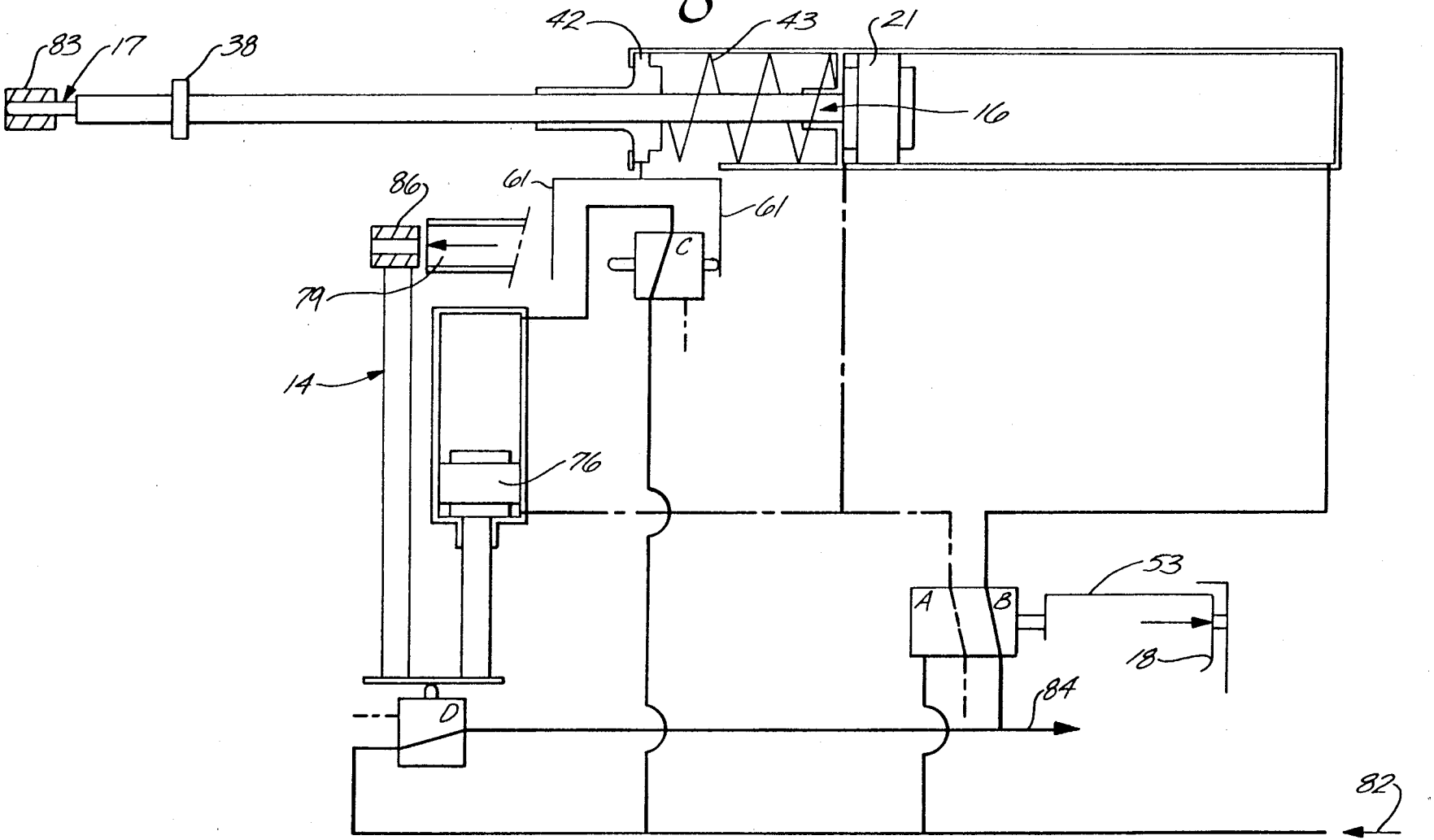
Figure 10F:
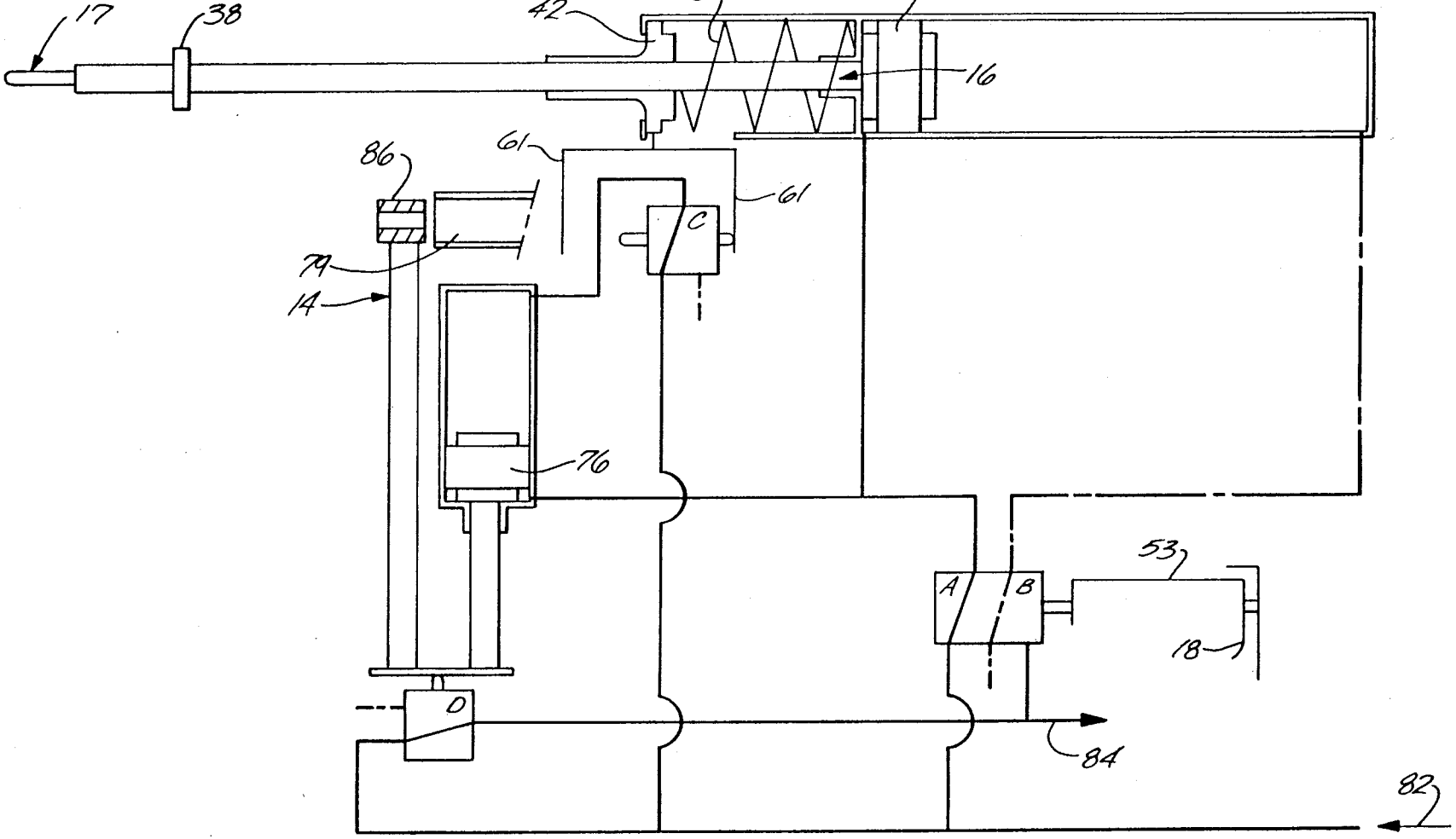
Figure 10B:
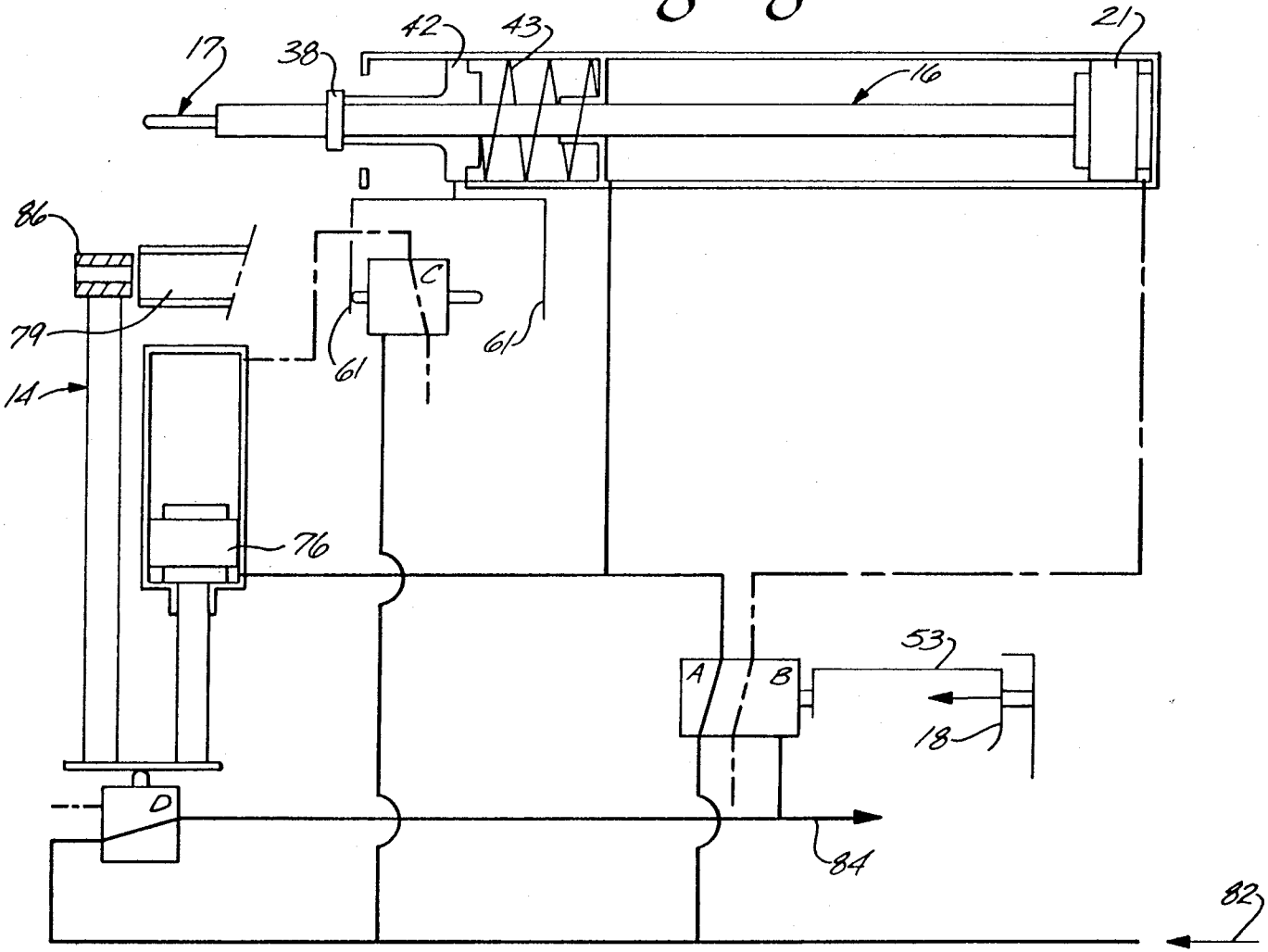

The plunger is illustrated in its extended position in FIG. 4 and also in the schematic illustrations of FIGS. 10*e* and 10*f*. In this position, the plunger extends beyond the front of the housing for the tool so that the nut on the pickup mechanism can be seen by the operator and placed on the end of a bolt to which it is being assembled. The plunger assembly moves to this position after a momentary stop in the pickup position when the trigger is depressed, and remains in the extended position until the trigger is released.

The nut plunger assembly has a tube 19 extending most of its length. At the rear of the tool the tube is secured to a drive piston 21, which is sealed to the housing of the tool by an O-ring 22. This assembly of tube and piston is kept from rotating by a hexagonal shaft 23 secured in the back of the housing and extending through a hexagonal hole through the drive piston 21. The inside of the tube is sealed by an O-ring on a plug 24 at the forward end of the hexagonal shaft.

Compressed air is admitted into a chamber behind the plunger drive piston 21 by way of an air passage 26 through the housing. It should be recognized that the air passage is illustrated schematically since it is not actually in the axial plane of the longitudinal cross section. In a practical embodiment, the air passage is forward of the plane of this illustration, and there is another air passage (not illustrated) in the housing behind the plane of the illustration for introducing compressed air in front of the drive piston. Such connections are illustrated schematically in FIG. 10 and can readily be provided in a desired location by those skilled in the art.

It will also be recognized that additional pneumatic connections of the tool indicated in FIG. 10, which are typically made by small size flexible tubing, have been omitted from the cross-sectional drawings to enhance clarity. Illustrations of these details are not needed for an understanding of this invention and would simply obscure the mechanical details that are appropriate for enabling one to make and use this invention.

The nut pickup mechanism 17 (also illustrated in detail in FIG. 9) extends beyond the end of the plunger tube 19. A hexagonal key 27 passes through the hexagonal hole of a retaining ring 28 threaded into the end of the plunger tube 19 with a left-hand thread to keep it from coming lose during use of the tool. The end of the key engages a movable plug 29 which can slide axially within the tube. The retaining ring 28 keeps the plug 29 within the tube. The plug is biased toward the front of the tube by a long coil spring 31. A stepped shaft 32, which also has a hexagonal hole, fits on the other end of the key 27. A nut retaining spring ring 33 fits in a circumferential groove around the stepped shaft 32.

The spring ring is generally barrel-shaped to provide an external lead for entering the bore of a nut. The outside diameter of the spring ring is slightly larger than the diameter at the crest of the thread in the nut. Thus, as the spring ring moves into the nut, the ring is compressed and frictionally engages the bore of the nut along the thread crest. The degree of compression of the spring ring by the nut and clearance between the inside of the spring ring and the groove in the stepped shaft are sufficient that, when fully compressed by a standard nut, there is still clearance between the shaft and ring and the ring can rotate relative to the shaft.

To get the appropriate frictional contact between the spring ring and thread in an exemplary embodiment, for gripping a number 10 nut, the ring has an outside diameter of 4.2 millimeters, a wall thickness of 0.18 millimeter, a length of 3 millimeters, a lead of 15 degrees over $\frac{1}{4}$ of the length of the spring ring. The ring has a slot about $\frac{1}{2}$ millimeter wide on one side at an angle of about 15 degrees from the axis of the ring. A radial clearance of about 0.2 millimeter between the ring and shaft permits free rotation of the ring when inserted in a nut.

Other dimensions would be appropriate for other sizes of nuts.

As noted above, the plug 29 in the plunger tube is spring biased toward the front end of the tube by the coil spring 31, which bears at its opposite end against the plug 24 which is fixed relative to the housing of the tool. The spring is designed so that when the plunger assembly is in its retracted position, the spring force is about 4.5 to 5 kilograms. Thus, as the plunger assembly moves from its retracted position to the nut pickup position, there is a force of about 4.5 to 5 kilograms pressing the ring into the nut, which is adequate for securely mounting the nut on the spring ring.

On the other hand, when the plunger assembly is in its fully extended position, the spring force biasing the nut pickup assembly forward drops off to about ½ to 1 kilogram. The lower spring force makes it easier to place the nut on the bolt and advance the nut driver over the nut.

The nut driver comprises a cemented tungsten carbide driver ring 36 press fitted into the front end of a steel nut driver sleeve 37 which surrounds a part of the plunger tube 19. The inside of the tungsten carbide driver ring has a very generally triangular or deltoid configuration as illustrated in U.S. Pat. No. 4,260,005. The carbide driver ring also serves to retain the stepped shaft of the nut pickup assembly inside the end of the plunger assembly.

The opposite end of the driver sleeve 37 is threaded into the end of a driven gear 38. The driven gear is, in turn, mounted on the plunger tube by a ball bearing 39. The ball bearing is secured to the driven gear and the plunger tube by snap rings. Thus, the axial position of the driver sleeve relative to the plunger tube 19 is fixed, and the driver sleeve can rotate around the tube which is fixed with respect to rotation relative to the housing of the nut installation tool. A bearing sleeve 41 at the front of the installation tool supports the other end of the driver sleeve 37.

On the opposite side of the ball bearing 39 from the driver sleeve 37, there is a bobbin 42 through which the plunger tube 19 can slide. The front end of the bobbin passes through an aperture in the housing so that it may bear against a snap ring securing the ball bearing to the plunger tube. The bobbin is biased in that direction by a strong (10 kg.) coil spring 43 at its opposite end. The end of the spring bears against the rear of a pair of shoulders 44 on the bobbin. The front shoulder 44 is larger than the aperture through the housing for limiting the translation of the bobbin.

A shaft 46 extending longitudinally in the housing supports a tubular idler gear 47 on sleeve bearings 48. The idler gear is in the form of a long tube around the shaft with splines in the form of gear teeth running along the length. The splines engage the driven gear 38 which drives the nut driver. The splines also engage a driving gear 49 on a shaft 51. The driving gear 49 is driven by a hexagonal stud 52 which fits into the chuck of the pneumatic wrench. Thus, when the air motor of the pneumatic wrench is running the driving gear 49 rotates, which in turn rotates the idler gear 47, and driven gear 38. The driven gear is connected to the driver sleeve 37 and hence rotates the nut driver 36.

When the trigger of the pneumatic wrench is depressed, it moves an elongated shift rod 53 which extends a major portion of the length of the installation tool. A pair of tabs 54 on the shift rod 53 straddle the spool 56 of an air valve AB. Thus, the spool of the air valve is shifted longitudinally when the trigger of the pneumatic wrench is depressed or released.

A second, shuttle-operating air valve C is also mounted in the tool. The spool 57 of the second valve C is straddled by a pair of tabs 58 at the ends of a shift bar 59 which extends parallel to the shift rod 53. A pair of tabs 61 are spaced apart from each other on the opposite side of the shift bar from the downwardly extending tabs 58.

Figure 2:
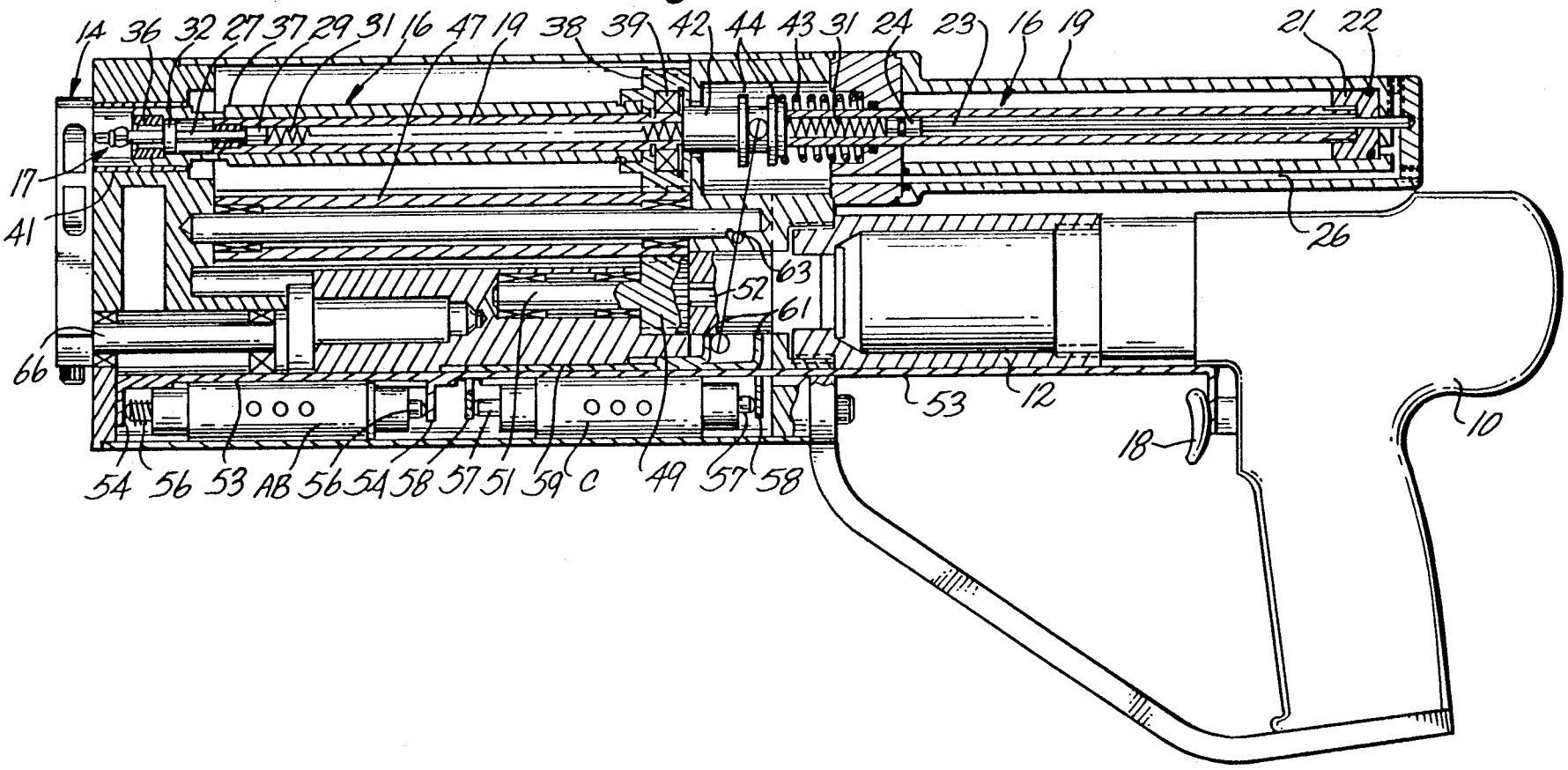
FIG. 2 is a longitudinal cross section through a portion of the nut installation tool in its retracted position.

A generally H-shaped rocker 62 (indicated schematically by a slightly diagonally extending single line 62 in FIG. 2) is mounted on a pivot 63 in the housing. The rocker has a generally H shape pivoted on its cross bar at the pivot point 63. The upper ends of the legs of the H straddle the bobbin 42 between the shoulders 44. The lower end of the legs of the H-shaped rocker lie between the upstanding tabs 61 on the shift bar 59 which straddle valve C.

As hereinafter described, during operation of the nut installation tool the bobbin 42 translates between a rearward position, as illustrated in FIG. 2, and a forward position, as illustrated in FIGS. 3 and 4. Such shifting causes the rocker to pivot around its cross bar 63 and the legs at the opposite end bear on the rear tab 61, thereby shifting the spool of the valve C as illustrated in FIGS. 3 and 4. Appreciable space is left between the tabs 61 to provide some "lost motion" and cause shifting of the spool of the valve only at the end of the stroke of the bobbin 42.

Figure 5:
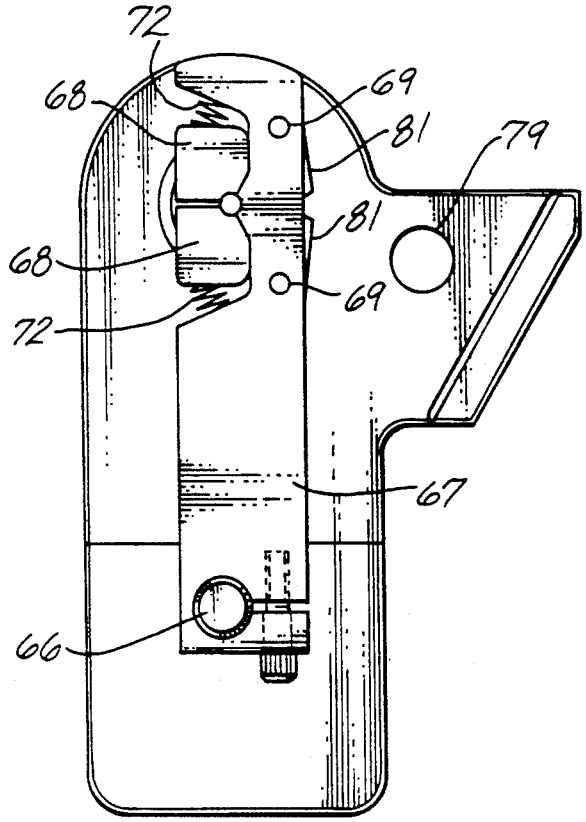
FIG. 5 is a front end view of a portion of the tool with a nut shuttle in its nut-delivery position.
Figure 6:
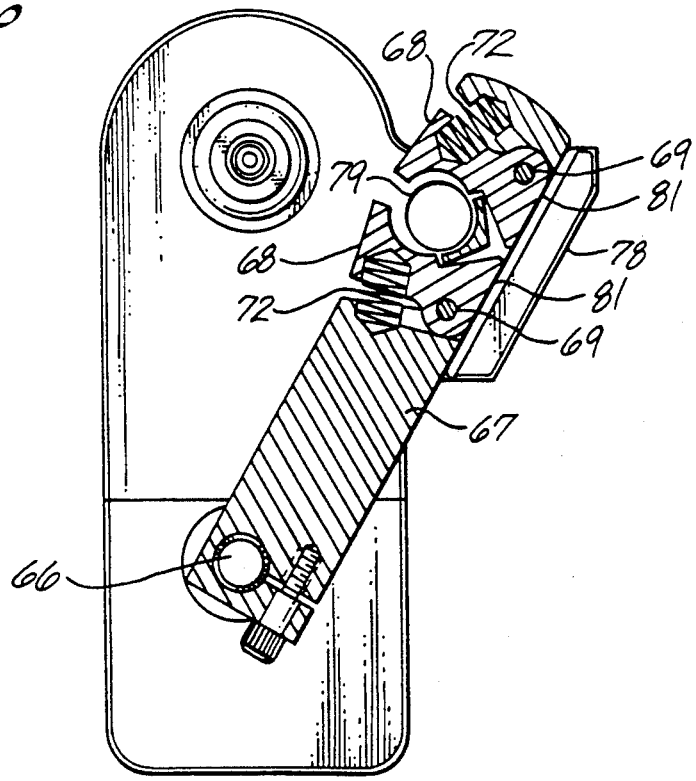
FIG. 6 is a similar front view of the tool with the shuttle shown in cross-section in its nut-receiving position.
Figure 7:
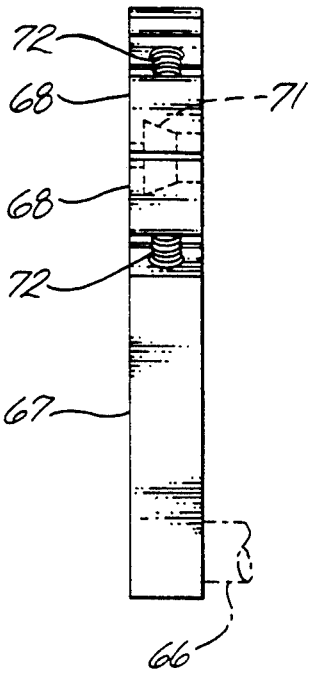
FIG. 7 is a side view of the nut shuttle.

As mentioned above, individual nuts are delivered in front of the plunger assembly when the plunger is in its retracted position. The nut shuttle and its operating mechanism are illustrated in FIGS. 5 to 8. FIGS. 5 and 6 illustrate the nut shuttle from the forward end of the installation tool with the shuttle in its nut-delivery position and its nut-receiving position, respectively. FIG. 7 is a side view of the nut shuttle.

Figure 8:
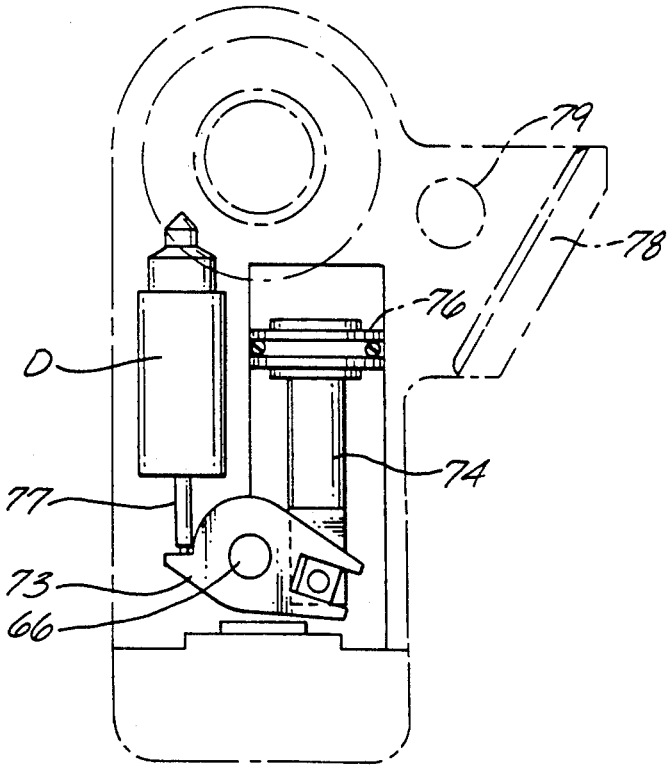
FIG. 8 is a fragmentary detail illustrating the operating piston for the nut shuttle.

FIG. 8 is a semi-schematic transverse cross section just inside the front end of the housing illustrating the operating mechanism for the nut shuttle. The comparable structure is not illustrated in the longitudinal cross section of FIGS. 2 to 4, since in the plane of that cross section, a showing of the operating mechanism could be confusing. Only the location of the mounting shaft 66 is indicated in this drawing.

The nut shuttle has a shuttle arm 67 secured to the mounting shaft 66. A pair of similar gate members 68 are mounted on the shuttle arm by a pair of pivot pins 69. After the gate members 68 are assembled on the shuttle arm, they are bored to form a nut-receiving cavity 71 having an enlarged mid-portion for temporarily holding a nut with a flange. The gate members are biased toward a closed position as illustrated in FIGS. 5 and 7 by a pair of coil springs 72. When the shuttle arm is in its nut-delivery position, as illustrated in FIG. 5, the nut-receiving cavity is aligned with the nut pickup assembly 17 at the end of the plunger assembly.

A shuttle rocker 73 (FIG. 8) is secured to the shuttle mounting shaft 66 inside the housing. One end of the shuttle rocker is connected to the shaft 74 of a shuttle actuator piston 76. The other end of the rocker is connected to the spool 77 of a spring-loaded shuttle valve D. When air pressure is applied above the shuttle actuator piston 76, the shuttle is moved downwardly as illustrated in FIG. 8, which tilts the shuttle arm toward its nut-receiving position as illustrated in FIG. 6, and also, at the end of its stroke, shifts the spool of the shuttle valve D.

In the nut-receiving position, the shuttle arm rests against a stop ledge 78, which places the nut receiving cavity in alignment with a nut feed hole 79 through which individual nuts are fed pneumatically from a hopper (not shown). The ledge 78 also engages a protruding camming surface 81 on the back of each of the gate members 68. This cams each of the gate members toward an open position against the bias of the springs 72 as illustrated in FIG. 6. This opens up the nut-receiving cavity to permit entry of a nut from the nut feed hole.

FIGS. 10*a* to 10*g* schematically illustrate operation of the nut installation tool. Generally speaking, the physical location of various parts in the schematic illustration does not correspond closely to the physical location on the installation tool itself, but where appropriate the same reference numerals have been used to indicate the same parts. Other liberties have been taken in preparing the schematic drawings to enhance clarity. For example, in these drawings the shuttle actuating piston 76 and nut shuttle assembly 14 have been indicated as if directly coupled together for actuating the valve D. In the actual mechanism, as mentioned above with respect to FIG. 8, rocker and shaft linkages are used to accomplish the function.

The heavy lines in FIG. 10 indicate pneumatic connections between the various valves and operating pistons of the installation tool. Solid heavy lines are used to indicate those pneumatic connections which are, at a given stage of operation, charged with compressed air from a source 82. Heavy phantom lines are used to indicate pneumatic connections which are, at a given stage of operation, vented through the respective valves and hence have no substantial air pressure.

FIG. 10*a* illustrates the starting position for the nut installation tool with air pressure applied to the tool, but with the trigger 18 released. In this condition air pressure is applied in front of the piston 21 on the plunger assembly 16, thereby keeping the plunger assembly retracted. Likewise, air pressure is applied below the shuttle piston 76, thereby keeping the shuttle assembly 14 in its nut-delivery position with a nut 83 aligned with the nut pickup assembly 17.

In part referring back to FIG. 2, when the plunger assembly is in its retracted position, the front end of the bobbin 42 engages the snap ring for the bearing on the driven gear 38. This forces the bobbin 42 toward the rear and compresses the spring 43.

When the trigger 18 is first depressed, as illustrated in FIG. 10*b*, the air motor of the pneumatic wrench (not illustrated in FIG. 10) commences rotating, thereby rotating the nut driver of the plunger assembly. At the same time, the spool of the valve AB is shifted by the shift rod 53. This results in venting of air pressure in front of the plunger piston 21 and below the shuttle piston 76. Thus, there is no air pressure on either side of these pistons.

As illustrated in FIG. 10*c*, the heavy spring 43 causes the bobbin 42 to move toward the front of the installation tool. The front of the bobbin causes the gear 38 to shift toward the front of the tool and since this is secured to the plunger tube 19, the entire plunger assembly moves forward. This is permitted since there is no air pressure difference across the plunger piston 21. The forward shifting continues until the front shoulder 44 on the bobbin engages the housing (FIG. 3).

This movement of the plunger assembly inserts the nut pickup assembly 17 into the nut 83. Furthermore, movement of the bobbin 42 also pivots the H-shaped rocker 62. After the lost motion between the tabs 61 has been taken up, the spool of the valve C is shifted. As will be apparent, this occurs at the end of the nut pickup stroke when the shuttle assembly is in its pickup position as illustrated in FIG. 3. When the valve C shifts, air pressure is then applied above the shuttle piston 76.

The air pressure above the shuttle piston causes a shifting of the piston as illustrated in FIG. 10*d*. This carries the entire nut shuttle assembly 14 away from its nut-delivery position toward the nut-receiving position. The gate members 68 pivot open to release the nut from the shuttle. The nut 83 remains on the nut pickup assembly. As the shuttle arm pivots, the nut-receiving cavity 71 moves into alignment with the nut feed hole 79 and the nut-receiving gates open. Shifting of the shuttle also shifts the spool of the valve D at the end of the shuttle stroke. This applies air pressure behind the plunger piston 21 and also sends an air pressure signal 84 to the pneumatic feeder (not shown).

The signal to the nut feeder causes pneumatic delivery of a second nut 86 through the nut feed hole 79 into the nut shuttle assembly 14, as illustrated in FIG. 10*e*. The air pressure applied behind the plunger piston 21 moves the entire plunger assembly 16 toward the front of the tool as illustrated in FIGS. 4 and 10*e*. The bobbin 42 is retained by engagement of the front shoulder 44 with the housing. The gear 38 is, however, driven forward along with the balance of the plunger assembly 16.

Referring for a moment back to FIG. 4, it will be noted that as the gear 38 moves forward, it remains in engagement with the elongated idler gear 47, which is rotated by the air motor by way of the driver gear 49. Thus, throughout the stroke of the plunger assembly, the nut driver continues rotating.

The nut 83 on the end of the extended plunger assembly is then placed on a bolt and pressed forward. This causes retraction of the nut pickup assembly and passage of the nut driver over the nut for tightening on the bolt.

As soon as the operator has installed the nut 83 on a bolt, the trigger is released. This causes shifting of valve AB as illustrated in FIG. 10*f*. The result is application of air pressure in front of the plunger piston 21 and below the shuttle piston 76. Air pressure behind the plunger piston 21 is vented. The shuttle piston remains in place since there is pressurized air on both sides.

The air pressure in front of the plunger piston forces the plunger assembly 16 toward its retracted position, as illustrated in FIG. 10*g*. When it reaches this position the tabs 61, engaged by the H-shaped rocker, shift the spool of the valve C, thereby venting the chamber above of the shuttle piston 76.

This effectively returns the installation tool to its initial position as illustrated in FIG. 10*a*. The nut shuttle assembly shifts to the nut-delivery position delivering a second nut in front of the nut pickup assembly. The initial movement of the nut shuttle also shifts the spool of the valve D which vents the signal to the nut feeder. The cycle of operation is then ready for repetition.

Summarizing the operation, when the operator depresses the trigger, the plunger assembly moves forward from the retracted position illustrated in FIG. 2 to the nut pickup position illustrated in FIG. 3. When the plunger assembly has moved forward to its nut pickup position with the nut pickup assembly in the nut, the shuttle arm flips out of the way to one side so that the plunger assembly can further extend. After a brief hesitation as the valves operate to let the shuttle clear, the plunger assembly moves forward to the extended position protruding several centimeters from the end of the tool as illustrated in FIG. 4. The nut driver is meanwhile rotating at about 300 rpm.

When the operator has the nut, which can now be clearly seen in front of the tool, aligned with a bolt the tool is pressed forward. The nut pickup assembly retracts into the tube 19 due to pressure against the bolt, and the nut driver moves over the outside of the nut, spinning it tight on the bolt. As soon as this occurs, the operator releases the trigger and the plunger assembly retracts inside the tool. The nut shuttle immediately delivers another nut in front of the plunger assembly.

Although one specific embodiment of automatic nut installation tool has been described and illustrated, many modifications and variations will be apparent to those skilled in the art. An example of such a variation is suggested in the schematic drawings of FIG. 10 where the nut shuttle assembly and its actuating piston stroke together in a longitudinal direction and activate the valve D at the end of the stroke. Such a structure could be used in lieu of the shaft, rocker and tilting shuttle arm described in the preferred embodiment. The shuttle might also be driven by a worm or crank in other embodiments.

Also, although described in the context of a pneumatic tool, it will be apparent that electrical actuating elements could be substituted. Modifications to handle various dimensions of nuts would also be an apparent variation, and in fact, may be readily implemented by simply changing the nut pickup assembly and nut driver.

Pneumatic delivery of nuts to the nut shuttle may be changed to provide for nut delivery from a magazine attached to the tool. Because of such modifications and variations, it is to be understood that within the scope of the appended claims, the invention may be practiced otherwise than as specifically described.

What is claimed is:

1. A collar installation tool comprising:

a shaft;

a circumferential groove in the shaft;

a spring ring on the shaft having a larger inside diameter than the bottom of the groove in the shaft for freely rotating on the shaft, a larger outside diameter than the inside diameter of a collar, and a longitudinally extending split for accommodating changes in diameter for receiving a collar around the outside diameter of the ring and resiliently holding the collar;

means around the shaft for fastening a collar on a pin; and a non-round key coaxial with the shaft and extending beyond an end of the ring for preventing rotation of a threaded pin.

2. A collar installation tool comprising:

a shaft;

a circumferential groove in the shaft;

a spring ring on the shaft having a larger inside diameter than the bottom of the groove in the shaft for freely rotating on the shaft, a larger outside diameter than the inside diameter of a collar, and a longitudinally extending split for accommodating changes in diameter for receiving a collar around the outside diameter of the ring and resiliently holding the collar; and means around the shaft for fastening a collar on a pin.

3. A collar installation tool as recited in claim 2 wherein the means for fastening a collar on a pin comprises means for rotating a collar around the shaft.

4. A collar installation tool as recited in claim 3 wherein the spring ring comprises a tapered external surface adjacent at least one end for easing insertion of the ring into a collar.

* * * * *